US006849995B2

(12) United States Patent
Suzuki

(10) Patent No.: US 6,849,995 B2
(45) Date of Patent: Feb. 1, 2005

(54) SPARK PLUG AND METHOD FOR MANUFACTURING THE SPARK PLUG

(75) Inventor: Akira Suzuki, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 10/327,061

(22) Filed: Dec. 24, 2002

(65) Prior Publication Data

US 2003/0168955 A1 Sep. 11, 2003

(30) Foreign Application Priority Data

Dec. 28, 2001 (JP) ..... 2001-401428

(51) Int. Cl.[7] ..... H01T 13/36; H01T 13/02
(52) U.S. Cl. ..... 313/143; 313/144
(58) Field of Search ..... 313/118, 143, 313/144, 140, 141; 445/7; 123/169 R

(56) References Cited

U.S. PATENT DOCUMENTS 2,308,968 A * 1/1943 Douglas ..... 219/149
5,695,704 A * 12/1997 Sugiura et al. ..... 264/249
2003/0155850 A1 * 8/2003 Suzuki ..... 313/143

FOREIGN PATENT DOCUMENTS

JP 63-148585 6/1988
JP 63-266046 11/1988
JP 2-70019 3/1990

* cited by examiner

*Primary Examiner*—Ashok Patel
*Assistant Examiner*—Karabi Guharay
(74) *Attorney, Agent, or Firm*—Sughrue Mion, PLLC

(57) ABSTRACT

A spark plug configured such that a metallic shell is joined to an insulator through hot-crimping. The metallic shell is firmly joined to the insulator by means of a sufficient fastening force even when the diameter of the spark plug is reduced, to thereby enhance gastightness and vibration resistance. A rear end portion of a metallic shell (1) is hot-crimped toward an insulator (2) to form a curved, crimped portion (1*d*). The inside diameter of an insulator insertion hole (40) of the metallic shell (1) is 8–12 mm. The cross-sectional area S of the metallic shell (1) as measured when the metallic shell (1) is cut by plane A—A perpendicular to the axis O at position (1*i*) where the inner wall surface of the insulator insertion hole (40) transitions to the inner wall surface of the crimped portion (1*d*) with respect to the direction of axis O of the metallic shell (1), and the carbon content of a steel material used to form the metallic shell (1) satisfy either of the following conditions A and B: condition A: $15 \leqq S < 25$ mm$^2$ and a carbon content of 0.20%–0.45% by weight; and condition B: $25 \leqq S < 35$ mm$^2$ and a carbon content of 0.15%–0.45% by weight. A method for manufacturing the spark plug is also disclosed.

2 Claims, 6 Drawing Sheets

SPARK PLUG AND METHOD FOR MANUFACTURING THE SPARK PLUG

BACKGROUND OF THE INVENTION

1. Field of the Invention

The present invention relates to a spark plug for igniting an internal combustion engine.

2. Description of the Related Art

The metallic shell of a spark plug is fixedly attached to an insulator by means of crimping. Specifically, the insulator is inserted into the metallic shell formed into a tubular shape, and then by use of dies a compressive load is applied to the peripheral edge of a rear end portion (a portion to be crimped) of the metallic shell. By this procedure, the portion to be crimped is curved toward a flange-like protrusion formed on the outer circumferential surface of the insulator to thereby become a crimped portion, whereby the insulator is fixed in place. The metallic shell is generally formed from a steel material such as carbon steel.

A method for firmly joining the insulator 2 to the metallic shell 1 by means of the crimped portion 1*d* is specifically carried out in the following manner. As shown in FIG. 2(*a*), when a portion-to-be-crimped 1*d*' is axially compressed by means of crimping die 111, the portion-to-be-crimped 1*d*' is plastically deformed radially inward. A thread packing 61, for example, is disposed between the portion-to-be deformed 1*d*' and a flange-like protrusion 2*e*. When compressive deformation of the portion-to-be-crimped 1*d*' increases, a load begins to be imposed on the thread packing 61 and the flange-like protrusion 2*e* (hereinafter, these are generically and collectively called a "portion to be compressed"). While the portion to be compressed undergoes compressive deformation, plastic deformation of the portion-to-be-crimped 1*d*' proceeds further. Then, as shown in FIG. 2(*b*) which is a step following the step shown in FIG. 2(*a*), when a final value for a compression stroke for crimping is reached, unloading is performed to thereby complete the crimping process (the portion-to-be-crimped 1*d*' becomes a crimped portion 1*d*). The unloading induces some springback of the crimped portion 1*d*. However, since the crimped portion 1*d* is plastically deformed, the crimped portion 1*d* retains the compressed portion in an elastically deformed condition, thereby inducing a fastening force for firmly joining the insulator 2 to the metallic shell 1. In some cases, the thread packing 61 may not be provided.

The above-mentioned crimping process is performed, for example, in the following manner. Crimping is performed while electricity is supplied to the metallic shell via the die to thereby heat to, for example, 700° C. or higher a thin-walled portion 1*h* formed between two protrusions (a tool engagement portion 1*e* and a flange-like gas seal portion 1*g*) so as to reduce deformation resistance; i.e., crimping is performed while deformation resistance is reduced. This crimping process is called hot crimping. Hot crimping can utilize the thermal expansion difference between the metallic shell 1 and the insulator 2 for crimping, whereby a highly gastight crimped structure can be readily obtained.

3. Problems Solved by the Invention

Along with a recent tendency of an engine toward complex arrangement around heads and an increase in valve diameter, spark plugs show a marked tendency towards a decrease in diameter and increase in length. However, decreasing the diameter of a spark plug requires employing a metallic shell having a small diameter and a thin wall. As is apparent from the above-described principle, a force for fastening the insulator against the metallic shell is induced by reaction from the crimped portion 1*d*. Since a reduction in the diameter and wall thickness of the metallic shell is accompanied by a reduction in the cross-sectional area of the crimped portion 1*d*, bringing stress arising on the cross section of the crimped portion 1*d* to the same level as a conventional one requires a reduction in compression stroke for crimping. Thus, total fastening force decreases by an extent corresponding to the reduction in the cross-sectional area. As a result, gas tightness established between the metallic shell and the insulator is deteriorated. Particularly, when harsh vibrations act on a spark plug as in high-speed, high-load driving, crimping of the spark plug may be loosened, and thus gastightness is more likely to deteriorate.

By contrast, an attempt to maintain the total fastening force at the same level as a conventional one involves an increase in stress by an extent corresponding to a decrease in the cross-sectional area of the crimped portion 1*d*; as a result, the strength of the crimped portion 1*d* fails to endure the stress, thereby leading to a failure to maintain gastightness. In hot crimping, the thin-walled portion 1*h* rises in temperature as a result of supply of electricity thereto and is plastically deformed. Therefore, a reaction force stemming from thermal expansion difference is also imposed on the thin-walled portion 1*h*. Since electricity-effected temperature rise varies widely among metallic shells, a reaction force stemming from thermal expansion difference also varies; as a result, lack of strength arises in the crimped portion 1*d*, and particularly impaired gastightness is likely to arise.

SUMMARY OF THE INVENTION

An object of the present invention is to enable, in a spark plug configured such that a metallic shell is joined to an insulator through hot-crimping, the metallic shell to be firmly joined to the insulator by means of a sufficient fastening force even when the diameter of the spark plug is reduced, to thereby enhance gastightness and vibration resistance.

The above object of the present invention is achieved by providing a spark plug comprising a rodlike center electrode, a rodlike insulator surrounding the center electrode and having a protrusion at a central portion thereof, a metallic shell assuming an open-ended, tubular shape and surrounding the insulator, and a ground electrode, a first end of the ground electrode being joined to the metallic shell and a second end of the ground electrode facing the center electrode to thereby define a spark discharge gap, and characterized in that:

an insulator insertion hole into which the protrusion of the insulator is inserted is formed in the metallic shell while extending in the direction of an axis (O); when a side toward the spark discharge gap with respect to the direction of the axis is taken as a front side, a rear end portion of the metallic shell is hot-crimped toward the insulator to form a curved, crimped portion;

two protrusions (1*e* and 1*g*) and a thin-walled portion (1*h*) are formed on an outer surface of said metallic shell (1) such that said thin-walled portion (1*h*) is located between said two protrusions (1*e* and 1*g*), the thin-walled portion (1*h*) is thinner than said two protrusions (1*e* and 1*g*), and assumes a section whose inner and outer surfaces are swollen in a radially convex condition with respect to said axis (O) and such that one of said protrusions (1*e* and 1*g*) is formed to be located adjacent to and on the front side of said crimped portion (1*d*); and the inside diameter of the insulator insertion hole of the metallic shell is 8–12 mm as measured at a position where the inner wall surface of the insulator insertion hole transitions to the inner wall surface of the crimped portion with respect to the direction of the axis of the metallic shell; and the cross-sectional area S of the metallic shell as measured when the metallic shell is cut at the position by a plane perpendicular to the axis, and the carbon content of a steel material used to form the metallic shell satisfies either of the following conditions A and B:

condition A: $15 \leqq S < 25$ mm$^2$ and a carbon content of 0.20%–0.45% by weight; and condition B: $25 \leqq S < 35$ mm$^2$ and a carbon content of 0.15%–0.45% by weight.

When a side toward a spark discharge gap with respect to the direction of the axis is taken as a front side, two protrusions are usually formed on the metallic shell of the spark plug to be located adjacent to and on the front side of the crimped portion of the metallic shell. One of the two protrusions is a tool engagement portion (a so-called hexagonal portion). When the spark plug is to be mounted into a plug attachment hole formed in an internal combustion engine, a tool such as a wrench is engaged with the tool engagement portion. Conventionally, the tool engagement portion of a spark plug has dominantly employed an opposite side-to-side dimension of 16 mm or more, so that the cross-sectional area of the crimped portion can be 40 mm$^2$ or more. However, the previously mentioned tendency to decrease the diameter of a spark plug is also bringing about increasing demand for reducing the size of the tool engagement portion, for, for example, the following reasons: employment of a direct ignition method—in which individual ignition coils are directly attached to upper portions of corresponding spark plugs-narrows an available space above a cylinder head; and the previously mentioned increase in area occupied by valves forces a reduction in the diameter of plug holes. As a result, the opposite side-to-side dimension of the tool engagement portion is forced to be reduced to, for example, 14 mm or less from a conventionally available dimension of 16 mm or more. Condition A or B of the present invention provides the range of the cross-sectional area of the crimped portion in view of employing a metallic shell whose diameter is reduced such that the opposite side-to-side dimension of the tool engagement portion is not greater than 14 mm, for example. Also, the range of the inside diameter (8–12 mm) of the insulator insertion hole of the metallic shell is determined in view of a reduction in the diameter of the metallic shell. Notably, the inside diameter of the insulator insertion hole of the metallic shell is that measured at a position corresponding to the tool engagement portion.

A feature of the present invention is to form the metallic shell whose crimped portion has a cross-sectional area as reduced as mentioned above, from a steel material whose carbon content is increased according to the cross-sectional area, so as to impart to the crimped portion strength capable of sufficiently enduring an increased fastening stress. As a result, the metallic shell can be firmly joined to the insulator by means of a sufficient fastening force, thereby enhancing gastightness and vibration resistance.

Specifically, the outside diameter of the metallic shell is classified into two categories, or condition A and condition B, according to the range of the cross-sectional area S of the crimped portion. Condition A employs the following range of the cross-sectional area S of the crimped portion: $15 \leqq S < 25$ mm$^2$. In this case, the carbon content of a steel material used to form the metallic shell is selected so as to fall within the range of 0.20% by weight to 0.45% by weight. Condition B employs the following range of the cross-sectional area S of the crimped portion: $25 \leqq S < 35$ mm$^2$. In this case, the carbon content of a steel material used to form the metallic shell is selected so as to fall within the range of 0.15% by weight to 0.45% by weight.

In either case, when the carbon content of a steel material falls below the lower limit, the strength of the crimped portion becomes insufficient to endure a fastening stress, thereby leading to lack of gastightness or vibration resistance. Condition A, which employs a narrower range of the cross-sectional area S of the crimped portion, sets a higher lower limit for the carbon content of a steel material, since greater stress is required than in the case of condition B in order to secure gastightness. Condition A also requires at least 15 mm$^2$ for the cross-sectional area S, since a metallic shell having a small diameter such that the cross-sectional area S of the crimped portion is less than 15 mm$^2$ fails to maintain gastightness. This also applies to the lower limit (8 mm) of the inside diameter of the insulator insertion hole of the metallic shell.

When the carbon content of a steel material is in excess of the upper limit (conditions A and B have the same upper limit), the metallic shell is apt to suffer quenching crack during cooling after hot crimping, due to a peculiarity of hot crimping. As shown in FIG. 2(*b*), this quenching cracks tends to occur at circumferential groove portions associated with the thin-walled portion 1*h* formed between the tool engagement portion 1*e* and the gas seal portion 1*g*; particularly, at an acute-angled boundary between the convexly swollen thin-walled portion 1*h* and the tool engagement portion 1*e* or the gas seal portion 1*g*. The reason is described below.

First, as an introduction, the transformation behavior of a carbon steel associated with heating and cooling will be briefly described. When iron that contains carbon is heated, as is apparent from the known iron-carbon-system binary phase diagram, a carbon steel assumes a mixed phase of ferrite and cementite at up to the A1 transformation point (pearlite transformation point: fixed point of temperature of 723° C.); the carbon steel assumes a mixed phase of ferrite and austenite in the temperature range between the A1 transformation point and the A3 transformation point; and the carbon steel is completely austenitized at the A3 transformation point or higher.

When cooling is performed at a critical rate or higher, the austenite phase does not return to the ferrite phase, but undergoes martensite transformation. Since the martensite transformation of iron is a diffusionless transformation, which is accompanied by significant volume expansion, the martensite phase is generated while involving great strain therearound, and constitutes a major factor in quench hardening of a steel. The degree of this hardening becomes marked as the amount of martensite increases. When the amount of martensite becomes excessively large, the material becomes brittle and is thus susceptible to quenching cracks.

As the carbon content increases, the above-mentioned A3 transformation point drops monotonously toward the pearlite eutectoid transformation point (carbon: 0.8% by weight). The aforementioned hot crimping temperature attained by electricity-effected heating tends to vary within the range of about 700° C. to 950° C. This temperature range can be understood to be a delicate range extending toward opposite sides of the A3 transformation point, from the austenitic phase to the mixed phase of ferrite and austenite with respect to the A3 transformation point.

On the above-mentioned premise, the reason why quenching cracks are apt to occur when carbon content exceeds the above-mentioned upper limit will be described with reference to FIG. 6. In FIG. 6, the horizontal axis represents carbon content, and the vertical axis represents temperature. When steel is quenched at a temperature lower than the A3 transformation point, the amount of martensite is small, and quenching cracks are unlikely to occur, since a portion of the microstructure has already been ferritized through diffusional transformation. However, when steel is quenched at a temperature higher than the A3 transformation point, the amount of martensite is large, and quenching cracks are likely to occur, since the entire microstructure is austenitized. The solid line of FIG. 6 represents carbon content dependency of quenching-crack-occurrence critical temperature which the present inventors studied. As is apparent from the solid line, as carbon content increases, the quenching-crack-occurrence critical temperature drops monotonously in correspondence with the A3 transformation point. When hot crimping is performed at a temperature above the solid line, quenching cracks are highly likely to occur in the process of cooling after crimping.

The dash-and-dot line in FIG. 6 represents a warning temperature (hereinafter called an ultimate warning temperature) to which the thin-walled portion possibly reaches in the process of electricity-effected hot crimping. Studies conducted by the present inventors have revealed that the ultimate warning temperature is about 950° C. Because a peculiarity of electricity-effected heating is that control for uniform heating is difficult, the thin-walled portion unavoidably reaches the above-mentioned ultimate warning temperature in the process of hot crimping.

As is apparent from FIG. 6, the line indicative of ultimate warning temperature and the line indicative of quenching-crack-occurrence critical temperature intersect at a point corresponding to a carbon content higher than 0.45% by weight, which is the upper limit of carbon content of the present invention. This means that there is a high possibility that the temperature of the thin-walled portion will exceed quenching-crack-occurrence critical temperature, with a resultant likelihood that quenching cracks will occur at the thin-walled portion in the process of cooling after crimping. However, a limitation of carbon content to 0.45% by weight or less renders the quenching-crack-occurrence critical temperature higher than ultimate warning temperature, thereby effectively preventing occurrence of quenching cracks at the thin-walled portion.

Next, an anticorrosive film is formed on most conventional types of metallic shells for spark plug use and formed from a carbon steel or the like. Galvanization, which is inexpensive and excellently anticorrosive, has been employed as a method for forming the anticorrosive film. However, in the case of the metallic shell used in the present invention and formed from a steel material of high carbon content, galvanization raises the following problem.

In electrogalvanization, zinc, which is more basic than iron, must be deposited on the surface of iron; therefore, the electric potential for galvanization is set relatively high. As a result, hydrogen tends to be generated in the process of galvanization. The thus generated hydrogen is absorbed into a base material, or a steel material. However, in the case of a high-strength steel material, the thus absorbed hydrogen is known to tend to cause hydrogen embrittlement; i.e., a high-strength steel material tends to become brittle as a result of absorption of hydrogen. The presence of restraint stress induced from tension is known to play an important role in occurrence of hydrogen embrittlement. The crimped portion of the metallic shell is subjected to tensile stress at all times in order to endure fastening stress and is thus likely to suffer hydrogen embrittlement.

In any case, when crimping is loosened as a result of hydrogen embrittlement, the gastightness and vibration resistance of the metallic shell are impaired. Hydrogen embrittlement fracture is known not to occur immediately upon establishment of embrittlement conditions (i.e., absorption of a certain amount or more of hydrogen and imposition of restraint stress), but to occur after a certain incubation period. Such fracture is also called a delayed cracking or delayed fracture.

The spark plug of the present invention uses a steel material whose strength is enhanced through an increase in carbon content as mentioned above. Since such a steel material is highly susceptible to hydrogen embrittlement, the crimped portion must be designed so as to prevent the occurrence of hydrogen embrittlement. The higher the restraint stress, the shorter the incubation period of delayed fracture. Therefore, delayed fracture is more likely to occur in the case of a spark plug in which fastening stress is increased as a result of reduction in the cross-sectional area of the crimped portion.

When galvanization is to be applied to the metallic shell of the spark plug of the present invention, the galvanization conditions must be carefully determined so as to prevent excessive generation of hydrogen in the process of galvanization. However, narrowing galvanization conditions involves difficulty in controlling the conditions, thereby leading to increased cost.

Thus, preferably, a nickel plating layer is employed in place of conventional galvanization, for use as an anticorrosive film to be formed on the metallic shell. In contrast to zinc, nickel is more noble than iron; thus, nickel can be deposited smoothly without the need to increase electric potential for electrolytic nickel plating. Therefore, nickel plating, by nature, is unlikely to involve generation of hydrogen and thus unlikely to raise a hydrogen embrittlement problem.

In the claims appended hereto, reference numerals assigned to elements are cited from the accompanying drawings for providing fuller understanding of the nature of the present invention, but should not be construed as limiting the invention.

DESCRIPTION OF REFERENCE NUMERALS

Figure 1:
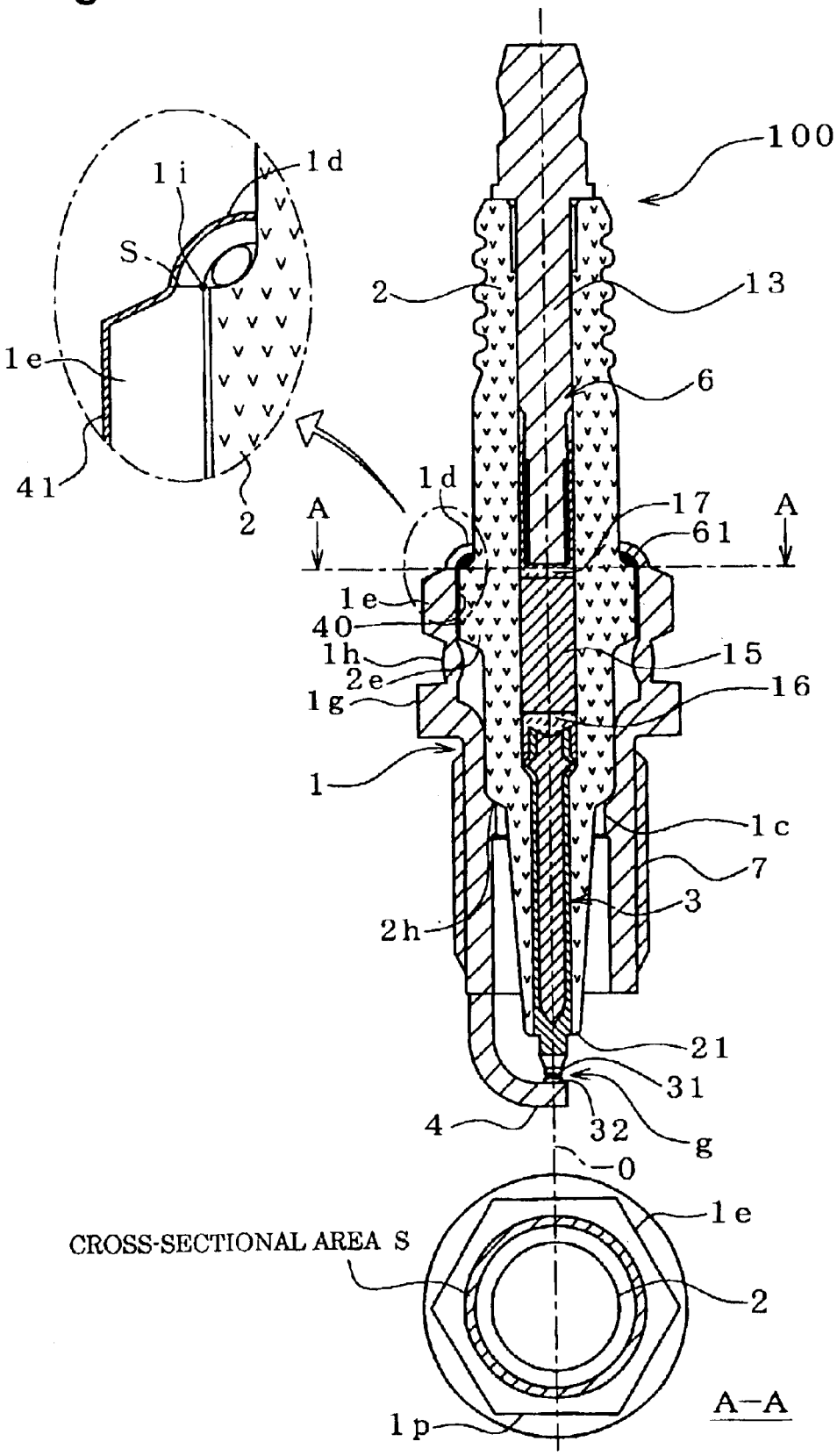
FIG. 1 shows views illustrating a spark plug according to a first embodiment of the present invention by use of various cross sections, and a view illustrating the opposite side-to-side dimension of a modified tool engagement portion.

100, 200, 300, 400: spark plugs
1: metallic shell

1*d*: crimped portion
1*e*: tool engagement portion
1*h*: thin-walled portion
2: insulator
3: center electrode
4: ground electrode
g: spark discharge gap
7: male-threaded portion
40: insulator insertion hole

DETAILED DESCRIPTION OF THE INVENTION

Modes for carrying out the present invention will next be described by way of embodiments illustrated in the accompanying drawings, which embodiments should not be construed as limiting the invention.

FIG. 1 shows a spark plug 100 according to an embodiment of the present invention. The spark plug 100 includes a tubular metallic shell 1; an insulator 2 fitted into the metallic shell 1 such that a front end portion 21 projects from the metallic shell 1; a center electrode 3 provided in the insulator 2 such that a noble-metal discharge portion 31 formed on its front end projects from the insulator 2; and a ground electrode 4, one end thereof being joined to the metallic shell 1 by means of welding or the like, the other end portion thereof being bent such that its side surface faces the discharge portion 31 of the center electrode 3. A noble-metal discharge portion 32 is formed on the ground electrode 4 in opposition to the noble-metal discharge portion 31. The noble-metal discharge portion 31 and the noble-metal discharge portion 32 form a spark discharge gap g therebetween.

The insulator 2 is formed from a ceramic sintered body such as alumina or aluminum nitride. The insulator 2 has a through-hole 6 formed therein along its axial direction so as to receive the center electrode 3. A metallic terminal member 13 is fixedly inserted into one end portion of the through-hole 6, whereas the center electrode 3 is fixedly inserted into the other end portion of the thorough-hole 6. A resistor 15 is disposed within the through-hole 6 between the metallic terminal member 13 and the center electrode 3. Opposite end portions of the resistor 15 are electrically connected to the center electrode 3 and the metallic terminal member 13 via conductive glass seal layers 16 and 17, respectively. A flange-like protrusion 2*e* is formed at a central portion of the insulator 2.

The metallic shell 1 is formed into a tubular shape from carbon steel and serves as a housing of the spark plug 100. A male-threaded portion 7 and two protrusions (the tool engagement portion 1*e* and the gas seal portion 1*g*) are formed on the outer circumferential surface of the metallic shell 1 and adapted to mount the spark plug 100 on an unillustrated engine block. When a side toward the spark discharge gap g with respect to the direction of the axis O is taken as the front side, a flange-like gas seal portion 1*g* is formed adjacent to the rear side of the male-threaded portion 7, and a tool engagement portion 1*e* with which a tool such as a spanner or wrench is engaged when the metallic shell 1 is to be mounted is formed on the rear side relative to the gas seal portion 1*g*. A thin-walled portion 1*h* is formed between the tool engagement portion 1*e* and the gas seal portion 1*g*. The wall of the thin-walled portion 1*h* is thinner than that of the tool engagement portion 1*e* and that of the gas seal portion 1*g*.

The tool engagement portion 1*e* has a plurality of pairs of mutually parallel tool engagement faces 1*p* extending in parallel with the axis O and arranged circumferentially. When the tool engagement portion 1*e* is to assume a regular hexagonal cross section, the tool engagement portion 1*e* has three pairs of the tool engagement faces. Alternatively, the tool engagement portion 1*e* may have 12 pairs of the mutually parallel tool engagement faces. In this case, the cross section of the tool engagement portion 1*e* assumes a shape obtained by shifting two superposed regular hexagonal shapes about the axis O by 30°. In either case, when the opposite side-to-side dimension Σ of the tool engagement portion 1*e* is represented by the distance between opposite sides of the hexagonal cross section, the opposite side-to-side dimension Σ of the tool engagement portion 1*e* is not greater than 14 mm.

An insulator insertion hole 40 of a metallic shell 1 into which the flange-like protrusion 2*e* of the insulator 2 is inserted has an inside diameter of 8–12 mm. A steel material is selected such that, when S represents the cross-sectional area of the metallic shell 1 (the cross-sectional area of the crimped portion) as measured on a plane (A—A) perpendicularly intersecting the axis O at a position 1*i* where the inner wall surface of the insulator insertion hole 40 transitions to the inner wall surface of the crimped portion 1*d* with respect to the direction of the axis O of the metallic shell 1, the cross-sectional area S of the crimped portion and the carbon content of a steel material used to form the metallic shell 1 satisfy either of the following conditions A and B:

condition A: $15 \leqq S < 25$ mm$^2$ and a carbon content of 0.20%–0.45% by weight; and condition B: $25 \leqq S < 35$ mm$^2$ and a carbon content of 0.15%–0.45% by weight.

A ringlike thread packing 61—which abuts a rear end edge portion of the flange-like protrusion 2*e*—is disposed between the inner surface of a rear opening portion of the metallic shell 1 and the outer surface of the insulator 2. The insulator 2 is pressed toward the front side while being inserted in the metallic shell 1, and then the opening edge of the metallic shell 1 is crimped inward toward the packing 61 to thereby form the crimped portion 1*d*, whereby the metallic shell 1 is firmly joined to the insulator 2. This crimping is performed by means of hot crimping as mentioned previously. Notably, an unillustrated gasket is fitted to a rear end part of the male-threaded portion 7 of the metallic shell 1 so as to abut the front end face of the gas seal portion 1*g*.

The entire outer surface of the metallic shell 1 is covered with a nickel plating layer 41 for anticorrosiveness. The nickel plating layer 41 is formed by a known electroplating process and has a thickness of, for example, about 3–15 μm (as measured on a tool engagement face of the tool engagement portion 1*e*). When the film thickness is less than 3 μm, sufficient anticorrosiveness may not be attained. By contrast, a film thickness in excess of 15 μm is unnecessarily thick in terms of attainment of anticorrosiveness and requires a long plating time, thereby leading to an increase in cost. Additionally, when the insulator 2 is to be joined by a crimping process, which will be described later, plating is likely to exfoliate at a portion subjected to crimping deformation.

A method for manufacturing the above-described spark plug 100 according to the present invention will next be described. First, the nickel plating layer 41 is formed on the metallic shell 1 by a known electroplating process. The insulator 2 having the center electrode 3, the conductive glass seal layers 16 and 17, the resistor 15, and the metallic terminal member 13 inserted into the through-hole 6 is inserted into the metallic shell 1 from an opening portion located on the rear side of the insulator insertion hole 40 until an engagement portion 2*h* of the insulator 2 and an engagement portion 1*c* of the metallic shell 1 are joined via a thread packing (not shown) (see FIG. 1 for these members). Next, the thread packing 61 is inserted into the metallic shell 1 from the insertion opening portion and disposed in place. Subsequently, a portion to be crimped of the metallic shell 1 is crimped toward the insulator 2 via the thread packing 61, thereby joining the metallic shell 1 and the insulator 2. This crimping process employs hot crimping.

Figure 2A:
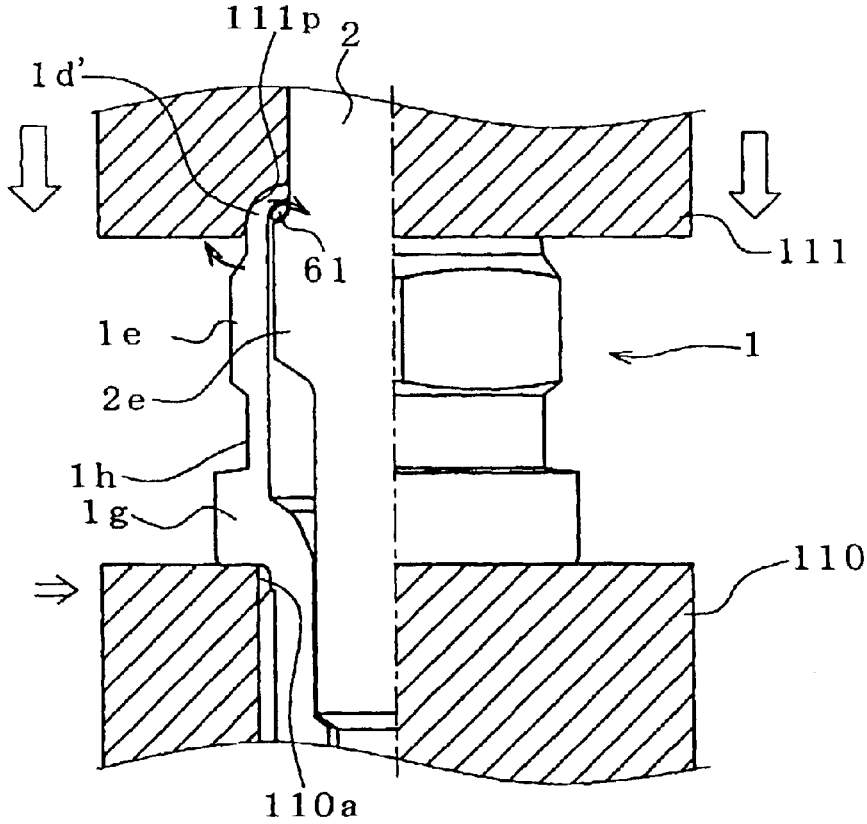
FIGS. 2(*a*) and 2(*b*) are views illustrating a crimping process.
Figure 2B:
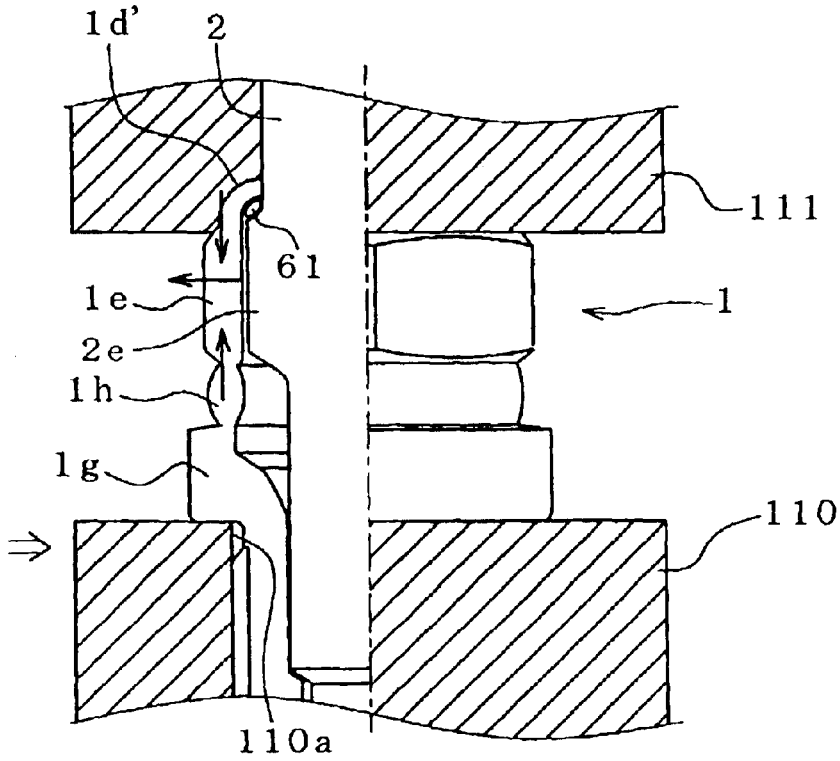

The above-mentioned crimping process can be specifically performed as shown in FIG. 2. First, as shown in a first step in FIG. 2(*a*), a front end portion of the metallic shell 1 is inserted into a setting hole 110*a* of a crimping base 110 such that the flange-like gas seal portion 1*g* formed on the metallic shell 1 resets on the opening periphery of the setting hole 110*a*. Notably, the crimped portion 1*d* of the metallic shell 1 in FIG. 1 assumes a cylindrical form before crimping, and the cylindrical portion is called a portion-to-be-crimped 1*d*'. Next, the crimping die 111 is fitted to the metallic shell 1 from above. A concave crimping action surface 111*p* corresponding to the crimped portion 1*d* (FIG. 1) is formed on a portion of the crimping die 111 which abuts the portion-to-be-crimped 1*d*'. In this state, while electricity is supplied to the metallic shell 1 from an unillustrated power supply via the crimping base 110 and the crimping die 111 so as to heat the metallic shell 1, an axial compressive force directed toward the crimping base 110 is applied to the crimping die 111 so as to move the crimping die 111 toward the crimping base 110; as a result, the portion-to-be-crimped 1*d*' is compressed while being curved radially inward along the crimping action surface 111*p*. As shown in a second step in FIG. 2(*b*), the metallic shell 1 and the insulator 2 are firmly joined through crimping. Application of a compressive force combined with supply of electricity causes the thin-walled portion 1*h* formed between the gas seal portion 1*g* and the tool engagement portion 1*e* to be heated and plastically deformed in a compressed condition, as shown in FIG. 2(*b*). Shutting off electricity while the compressed state is maintained causes the thermally expanded thin-walled portion 1*h* to be cooled, thereby enhancing a fastening force. Since the thin-walled portion 1*h* is compressed while its ends joined to the tool engagement portion 1*e* and the gas seal portion 1*g* are restrained, the thin-walled portion 1*h* undergoes a barrel-like deformation. After completion of hot crimping, the thin-walled portion 1*h* assumes a biconvex section whose inner and outer surfaces are swollen in a radially convex condition.

EXAMPLES

Next will be described the results of experiments conducted for confirming the effect of the present invention. However, the present invention should not be construed as being limited thereto.

Example 1

Figure 3:
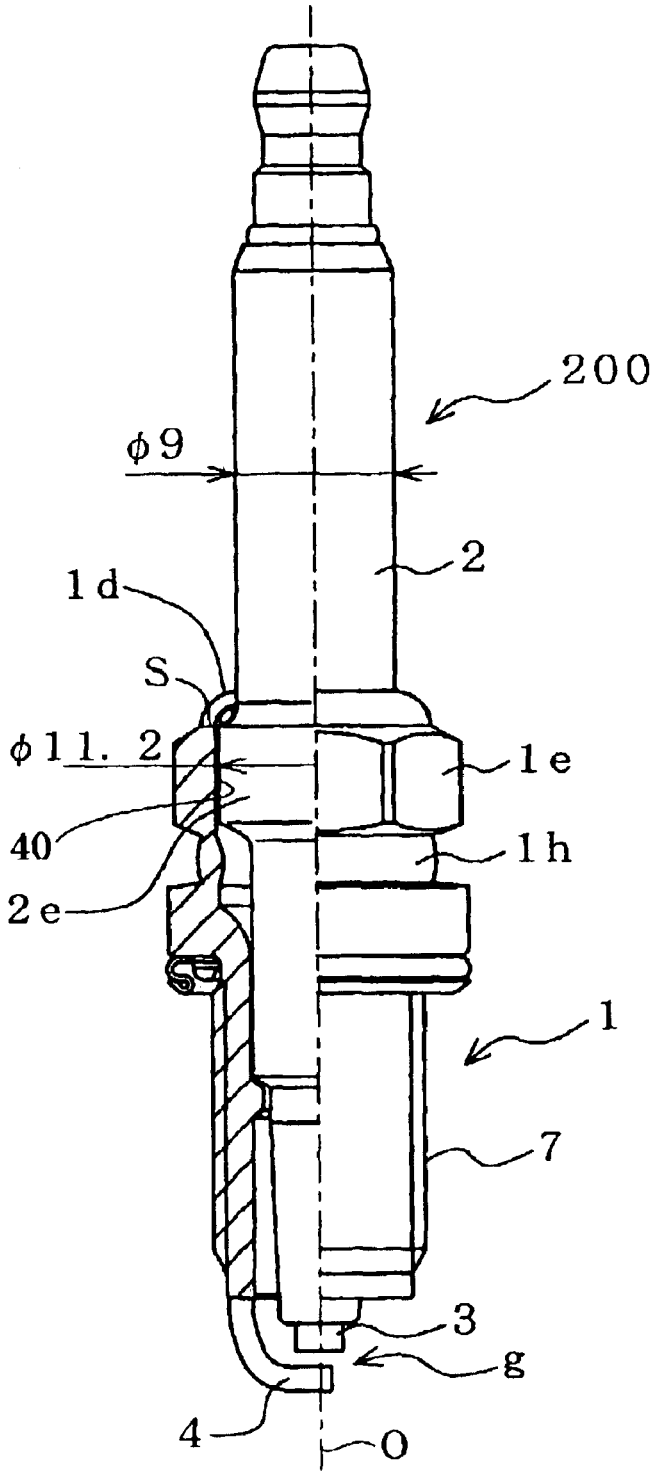
FIG. 3 is a longitudinal, partially sectional view showing a first spark plug according to the first embodiment.
Figure 4:
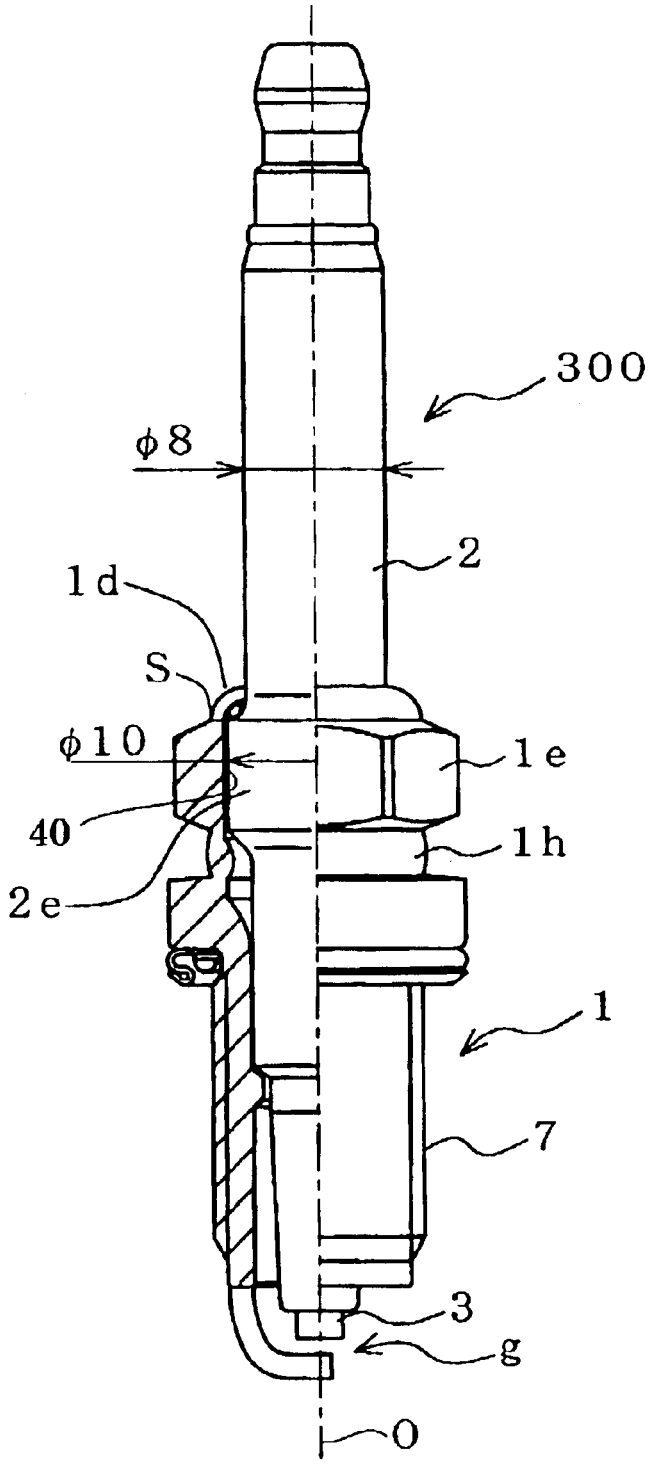
FIG. 4 is a longitudinal, partially sectional view showing a second spark plug according to the first embodiment.

Spark plugs 200 and 300 shown in FIGS. 3 and 4 were fabricated for test use. These spark plugs 200 and 300 are configured in a manner similar to that of the spark plug 100 of FIG. 1 except that the noble-metal discharge portions 31 and 32 are omitted. Structural features conceptually common to those of the spark plug 100 of FIG. 1 are denoted by common reference numerals (typical structural features are selected and assigned reference numerals). The crimped portion 1*d* is formed by means of hot crimping.

The spark plugs 200 and 300 have the following features:

Spark Plug 200 (FIG. 3)

Cross-sectional area S of crimped portion: 25–35 $mm^2$ (satisfying condition B);

Inside diameter of insulator insertion hole 40: 11.2 mm;

Hot crimping condition: applied pressure about 2–2.5 ton; and

Temperature: 850° C. as measured at thin-walled portion 1*h* by means of radiation thermometer.

Spark Plug 300 (FIG. 4)

Cross-sectional area S of crimped portion: 13–25 $mm^2$ (satisfying condition A);

Inside diameter of insulator insertion hole 40: 10 mm;

Hot crimping condition: applied pressure about 1.5–2.0 ton; and

Temperature: 850° C. as measured at thin-walled portion 1*h* by means of radiation thermometer.

In the spark plugs 200 and 300, the carbon content of the carbon steel used to form the metallic shell 1 was varied in the range of 0.05% by weight to 0.50% by weight. These spark plugs 200 and 300 were subjected to a hot airtightness test under the conditions below and measured for air leakage from the crimped portion 1*d* (portion filled with the filler material 61).

(Test Conditions)

Ambient temperature: 200° C.

Vibrating conditions: as described in ISO15565

Vibration frequency: 50–500 Hz

Sweep rate: 1 octave/minute

Acceleration: 30 GN

Vibrating direction: perpendicular to axis O of spark plug

Vibrating time: 16 hours (Measurement Conditions)

Air pressure: 2 Mpa

Test temperature: 150° C.

Under the above conditions, the measurement criteria were as follows: good (O): no air leakage; acceptable (Δ): leakage less than 10 cc; and not acceptable (x): leakage not less than 10 cc. While test quantity n is 3, test results are shown for individually tested spark plugs. Furthermore, 1000 spark plugs (test quantity n is 1000) for each carbon content were tested for the occurrence of quenching cracks in the thin-walled portion 1*h* under the following condition: after hot crimping, the spark plugs were subjected to forced cooling by means of fan cooling. The measurement criteria were as follows: good (O): none of tested spark plugs suffered quenching cracks; and defective (x): even a single tested spark plug suffered quenching cracks. Notably, as confirmed by a radiation thermometer, the maximum temperature of the thin-walled portion 1*h* during hot crimping was about 950° C. Table 1 shows the test results of the spark plugs 200 and 300.

TABLE 1

| Carbon Content (by weight %) | | 0.05 | 0.10 | 0.15 | 0.20 | 0.30 | 0.40 | 0.50 | types |
|---|---|---|---|---|---|---|---|---|---|
| Cross-sectional Area/S ($mm^2$) | 13 | x,x,x | x,x,x | Δ,x,x | Δ,Δ,x | Δ,Δ,x | Δ,Δ,x | Δ,Δ,x | 300 |
| | 15 | x,x,x | x,x,x | Δ,x,x | Δ,Δ,Δ | Δ,Δ,Δ | ○,Δ,Δ | ○,Δ,Δ | |
| | 17 | x,x,x | x,x,x | Δ,x,x | Δ,Δ,Δ | ○,Δ,Δ | ○,Δ,Δ | ○,○,Δ | |
| | 19 | x,x,x | x,x,x | Δ,Δ,x | ○,Δ,Δ | ○,○,Δ | ○,○,Δ | ○,○,○ | |
| | 21 | x,x,x | Δ,x,x | Δ,Δ,x | ○,Δ,Δ | ○,○,Δ | ○,○,○ | ○,○,○ | |
| | 23 | x,x,x | Δ,x,x | Δ,Δ,x | ○,Δ,Δ | ○,○,○ | ○,○,○ | ○,○,○ | |
| | 25 | x,x,x | Δ,Δ,x | Δ,Δ,Δ | ○,○,Δ | ○,○,○ | ○,○,○ | ○,○,○ | |
| | 25 | x,x,x | Δ,Δ,x | Δ,Δ,Δ | ○,○,Δ | ○,○,○ | ○,○,○ | ○,○,○ | 200 |
| | 27 | x,x,x | Δ,Δ,x | ○,Δ,Δ | ○,○,Δ | ○,○,○ | ○,○,○ | ○,○,○ | |
| | 28 | x,x,x | Δ,Δ,x | ○,Δ,Δ | ○,○,Δ | ○,○,○ | ○,○,○ | ○,○,○ | |
| | 31 | x,x,x | Δ,Δ,x | ○,Δ,Δ | ○,○,Δ | ○,○,○ | ○,○,○ | ○,○,○ | |
| | 33 | x,x,x | Δ,Δ,x | ○,Δ,Δ | ○,○,Δ | ○,○,○ | ○,○,○ | ○,○,○ | |
| | 35 | x,x,x | Δ,Δ,x | ○,○,Δ | ○,○,○ | ○,○,○ | ○,○,○ | ○,○,○ | |
| Quenching Crack | | ○ | ○ | ○ | ○ | ○ | ○ | x | |

As is apparent from the above test results, the spark plugs 200 which satisfy the carbon content range of condition B and the spark pugs 300 which satisfy the carbon content range of condition A exhibited no air leakage at 150° C., whereby indicating that gastightness was maintained. Also, as is apparent from the test results, the spark plugs 200 and 300 having a carbon steel of a carbon content (0.5% by weight) in excess of 0.45% by weight, which is the upper limit of the present invention, were apt to suffer quenching cracks in the thin-walled portion 1*h*.

Example 2

Figure 5:
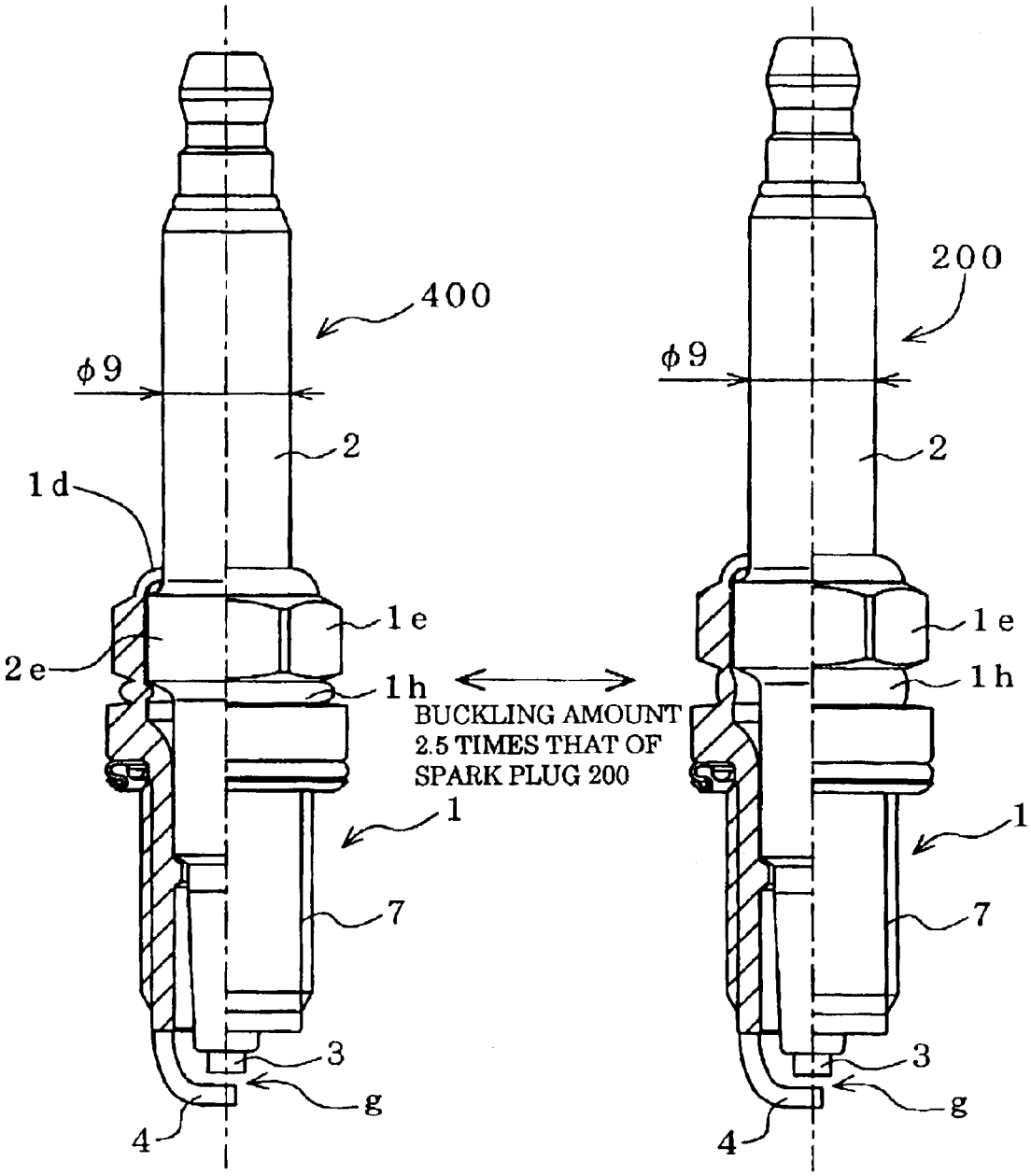
FIG. 5 shows longitudinal, partially sectional views comparing a spark plug according to a second embodiment with the first spark plug of the first embodiment.
Figure 6:
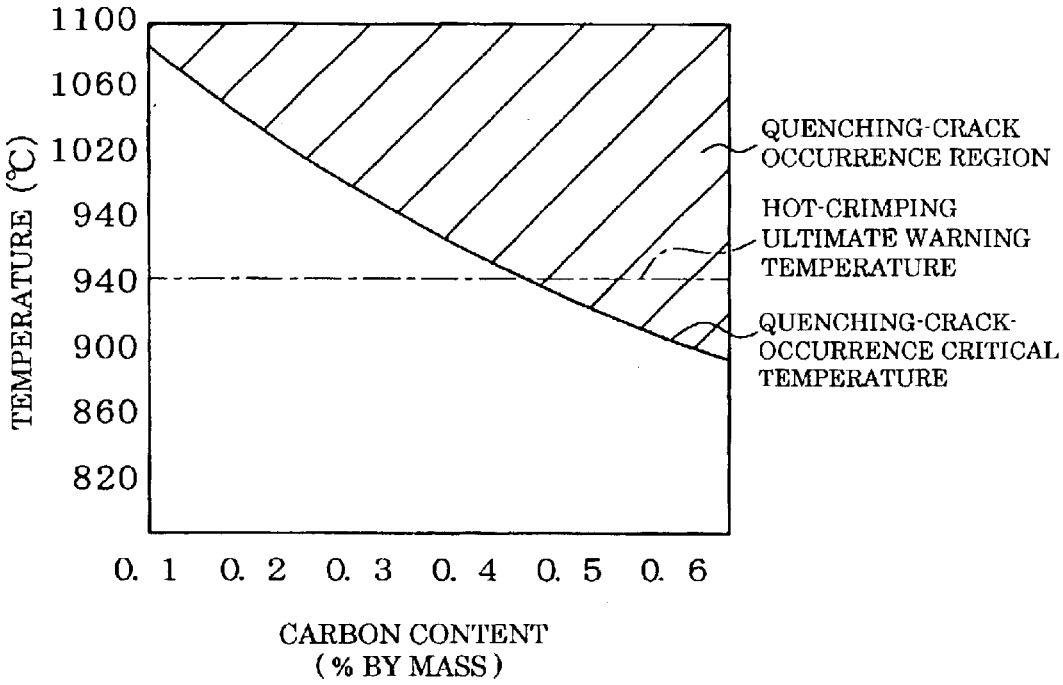
FIG. 6 is a graph showing carbon content dependency of quenching-crack-occurrence critical temperature and hot-crimping ultimate warning temperature of a metallic shell.

Various carbon steels of different carbon contents ranging from 0.05% by weight to 0.50% by weight were selected so as to form metallic shells therefrom. 20,000 metallic shells, each of which is identical to that of the spark plug 200 shown in FIG. 3, were manufactured from each of the selected carbon steels. An anticorrosive film was formed on the 20,000 metallic shells in the following manner: an electrolytic nickel plating layer having a thickness of 5 μm was formed on the 10,000 metallic shells, and an electrogalvanization layer having a thickness of 5 μm was formed on the remaining 10000 metallic shells. By use of the metallic shells, spark plugs 400 were manufactured in the following manner: the metallic shells were subjected to hot crimping of such an excessive compression stroke that, as shown in FIG. 5, the amount of compressive deformation of the thin-walled portion 1*h* was 2.5 times that of FIG. 3. The spark plugs 400 were allowed to stand for 48 hours at room temperature and then visually observed for the appearance of the metallic shells. The number of spark plugs 400 in which hair cracking induced from delayed fracture was observed in the crimped portion 1*d* or thin-walled portion 1*h* was recorded. The results are shown in Table 2.

TABLE 2

| Carbon content | Electrolytic nickel plating Quantity suffering cracking | Electrogalvanization Quantity suffering cracking |
|---|---|---|
| 0.05 | 0 | 0 |
| 0.1 | 0 | 0 |
| 0.15 | 0 | 9 |
| 0.20 | 0 | 14 |
| 0.30 | 0 | 20 |
| 0.40 | 0 | 25 |
| 0.50 | 0 | 31 |

This is an accelerated test which was conducted under far severer crimping conditions. As is apparent from the test results, when a steel material having a carbon content not less than 0.15% by weight is used, the use of a nickel plating layer as an anticorrosive film apparently reduces susceptibility to hydrogen embrittlement as compared with use of a galvanization layer.

It should further be apparent to those skilled in the art that various changes in form and detail of the invention as shown and described above may be made. It is intended that such changes be included within the spirit and scope of the claims appended hereto.

This application is based on Japanese Patent Application No. 2001-401428 filed Dec. 28, 2001, the disclosure of which is incorporated by reference herein in its entirety.

What is claimed is:

1. A spark plug comprising a rodlike center electrode (3), a rodlike insulator (2) surrounding said center electrode (3) and having a protrusion (2*e*) at a central portion thereof, a metallic shell (1) assuming an open-ended, tubular shape and surrounding said insulator (2), and a ground electrode (4), a first end of said ground electrode (4) being joined to said metallic shell (1) and a second end of said ground electrode (4) facing said center electrode (3) to thereby define a spark discharge gap (g), and characterized in that:

an insulator insertion hole (40) into which said protrusion (2*e*) of said insulator (2) is inserted is formed in said metallic shell (1) while extending in a direction of an axis (O); when a side toward said spark discharge gap (g) with respect to the direction of said axis (O) is taken as a front aide, a rear end portion of said metallic shell (1) is hot-crimped toward said insulator (2) to thereby form a curved, crimped portion (1*d*);

two protrusions (1*e* and 1*g*) and a thin-walled portion (1*h*) are formed on an outer surface of said metallic shell (1) such that said thin-walled portion (1*h*) is located between said two protrusions (1*e* and 1*g*), the thin-walled portion (1*h*) is thinner than said two protrusions (1*e* and 1*g*), and assumes a section whose inner and outer surfaces are swollen in a radially convex condition with respect to said axis (O) and such that one of said protrusions (1*e* and 1*g*) is formed to be located adjacent to and on the front side of said crimped portion (1*d*); and an inside diameter of said insulator insertion hole (40) of said metallic shell (1) is 8–12 mm as measured at a position (1*i*) where an inner wall surface of said insulator insertion hole (40) transitions to an inner wall surface of said crimped portion (1*d*) with respect to the direction of said axis (O) of said metallic shell (1); and a cross-sectional area S of said metallic shell (1) as measured when said metallic shell (1) is cut at said position (1*i*) by a plane perpendicular to said axis (O), and a carbon content of a steel material used to form said metallic shell (1) satisfies either of the following conditions A and B:

condition A: $15 \leqq S < 5$ mm$^2$ and a carbon content of 0.20%–0.45% by weight; and condition B: $25 \leqq S < 35$ mm$^2$ and a carbon content of 0.15%–0.45% by weight.

2. The spark plug as claimed in claim 1, comprising a nickel plating layer formed on said metallic shell (1) so as to serve as an anticorrosive film.

* * * * *

UNITED STATES PATENT AND TRADEMARK OFFICE

CERTIFICATE OF CORRECTION

PATENT NO. : 6,849,995 B2
APPLICATION NO. : 10/327061
DATED : February 1, 2005
INVENTOR(S) : Akira Suzuki It is certified that error appears in the above-identified patent and that said Letters Patent is hereby corrected as shown below:

Column 13, lines 7-8,
delete "condition A: $15 \leqq S < 5$ mm$^2$ and a carbon content of 0.20%-0.45% by weight; and"
and insert
--condition A: $15 \leqq S < 25$ mm$^2$ and a carbon content of 0.20%-0.45% by weight; and--

Signed and Sealed this

Eighth Day of July, 2008

JON W. DUDAS
*Director of the United States Patent and Trademark Office*